United States Patent [19]

Mage

[11] Patent Number: 4,603,311

[45] Date of Patent: Jul. 29, 1986

[54] TWIN STRIP RESONATORS AND FILTERS CONSTRUCTED FROM THESE RESONATORS

[75] Inventor: Jean-Claude Mage, Levallois-Perret, France

[73] Assignee: Thomson-CSF, Paris, France

[21] Appl. No.: 545,515

[22] Filed: Oct. 26, 1983

[30] Foreign Application Priority Data

Oct. 29, 1982 [FR] France ..... 82 18236

[51] Int. Cl.[4] ..... H01P 1/201; H01P 7/00

[52] U.S. Cl. ..... 333/202; 333/203; 333/219; 333/222

[58] Field of Search ..... 333/202-207, 333/219, 222, 223, 227, 238, 245, 246, 208-212

[56] References Cited

U.S. PATENT DOCUMENTS

| | | | |
|---|---|---|---|
| 2,774,046 | 12/1956 | Arditi et al. | 333/238 X |
| 2,820,206 | 1/1958 | Arditi et al. | 333/205 |
| 2,838,736 | 6/1958 | Foster | 333/227 |
| 3,327,255 | 6/1967 | Bolljahn et al. | 333/203 |
| 3,673,509 | 6/1972 | Cooper, Jr. | 333/204 X |

FOREIGN PATENT DOCUMENTS

| | | |
|---|---|---|
| 2805965 | 8/1978 | Fed. Rep. of Germany . |
| 2496995 | 6/1982 | France . |

OTHER PUBLICATIONS

Electronic Letters, vol. 18, No. 15 (Jul. 22, 1982), G. Ohm et al, "750 MHz Microstrip Bandpass Filter on Barium Tetratitanate Substrate," pp. 661-663.

IEEE Transactions on Broadcasting, vol. BC-26, No. 1 (Mar. 1980), K. Wakino et al, "Bandpass Filter with Dielectric Materials Used for Broadcasting Channel Filter," pp. 1-6.

IEEE Transactions on Microwave Theory and Techniques, vol. MTT-21, No. 10 (Oct. 1973), J. Watkins, "Radiation Loss from Open-Circuited Dielectric Resonators," pp. 636-639.

IEEE Transactions on Microwave Theory and Techniques, vol. MTT-19, No. 7 (Jul. 1971), T. D. Iveland, "Dielectric Resonator Filters for Application Microwave Integrated Circuits," pp. 643-652.

G. L. Matthaei et al, "Microwave Filters, Impedance-Matching Networks and Coupling Structures," McGraw-Hill, New York, pp. 421-434; 725-749; 768-771 (1964).

Howe, Jr.—"Stripline Circuit Design", Microwave Associates, Burlington, Mass, copyright 1974, Artech House, Inc., third printing, 1979; pp. 213-219.

*Primary Examiner*—Marvin L. Nussbaum

*Attorney, Agent, or Firm*—Oblon, Fisher, Spivak, McClelland & Maier

[57] ABSTRACT

The invention provides electromagnetic resonators and high frequency filters constructed from these resonators which are formed by parallelepipeds made from a dielectric material, each of these parallelepipeds being covered with at least two metalizations disposed parallel to the direction of movement of an electromagnetic wave.

3 Claims, 8 Drawing Figures

TWIN STRIP RESONATORS AND FILTERS CONSTRUCTED FROM THESE RESONATORS

BACKGROUND OF THE INVENTION

1. Field of the Invention

The present invention relates to a type of electromagnetic resonator, which may be called "twin strip resonator" as well as to the high frequency filters constructed from these resonators.

2. Description of the Prior Art

In the high frequency range called UHF (in practice from 300 MHz to 3 GHz), the resonators and the filters constructed from these elements are often formed from line sections. They may be air coaxial lines or dielectric charged coaxial lines such as mentioned in the article: "Bandpass filter with dielectric materials used for broadcasting channel filter" by K. WAKINO and Y. KONISHI published in the I.E.E.E. review Transactions on Broadcasting, vol BC-26, No. 1, March 1980. It is also known to manufacture resonators and filters from microstrip lines as mentioned in the article: "750 MHz microstrip bandpass filter on barium tetratitanate substrate" by G. OHM and G. SCHMOLLER published in the review Electronics Letters, vol 18, No. 15 of July 22, 1982.

The technique of coaxial lines allows the manufacture of independent resonators whose natural frequencies may be adjusted before assembly thereof to form filters. This assembly may be achieved in the case of a passband filter by placing the different resonators end to end, the couplings between two consecutive line sections being determined by the distances which separate their oppositely located faces. However, to obtain interesting Q factors (greater than 500) line sections are required having a fairly large cross section. Typically, a silver metallized resonator with a diameter of 20 mm may have a Q factor greater than 1000 for a frequency of 1 GHz. Moreover, the coupling of quarter-wave resonators remains delicate and the construction itself of the coaxial structure is fairly complex because of the different operations for machining and metalizing circular section elements.

Resonators may be designed according to the technique of microstrip lines. They are generally formed from a relatively wide dielectric substrate one face of which is entirely metalized and the other face of which receives a metal conductor in the form of a thin ribbon. This technique has two disadvantages. On the one hand, the natural Q factors of the resonators are always low (less than 500) and, consequently, the performances of filters formed from these resonators are always modest (high insertion losses, greater than 3 dB at about 1 GHz). On the other hand, once the filter has been constructed, by depositing strips on the same substrate, it is practically impossible to adjust the natural frequencies of the resonators as well as their mutual coupling. This puts an obstacle in the way of the industrial production of filters comprising a high number of poles because of the inevitable dispersions of the characteristics: in particular, of the dielectric constant of the substrate.

SUMMARY OF THE INVENTION

In order to overcome these disadvantages, the invention proposes constructing resonators from a parallelepiped formed from a dielectric material. A line is formed by metalizing two opposite faces of the parallelepiped and a $\lambda/4$ or $\lambda/2$ resonator depending on the length and the termination of the line. The invention provides then a resonator comprising a line section with distributed constants along which is established stationary working of transverse electromagnetic waves, said length comprising two conducting elements separated by a dielectric medium, wherein said medium is formed by a dielectric solid with six faces, four at most of said faces being entirely covered by a metalization and two other uncovered faces being opposite each other.

The invention also provides a high frequency filter comprising at least one resonator in accordance with the invention.

BRIEF DESCRIPTION OF THE DRAWINGS

The invention will be better understood and other advantages will appear from the following description and the accompanying figures in which.

DETAILED DESCRIPTION OF THE PREFERRED EMBODIMENT

Figure 1:
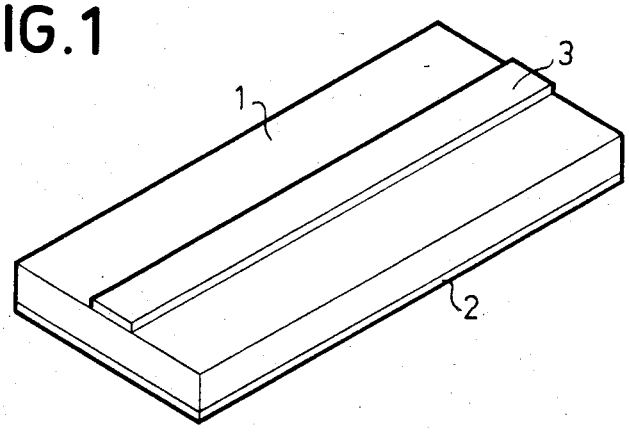
FIG. 1 shows a microstrip line.
Figure 2:
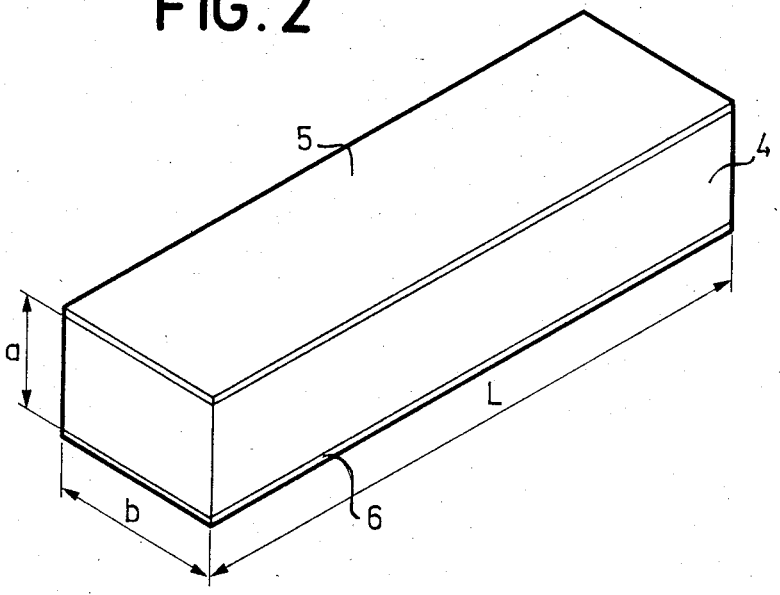
FIGS. 2 and 3 show half-wave resonators in accordance with the invention.

FIG. 1 shows a wave-guide which is called microstrip line. This line is formed by a flat dielectric substrate 1 covered on its lower face with a metalization 2. The opposite face of the substrate receives a conducting strip 3. This is a fairly well known technique for constructing wave-guides. Wave-guides may be considered formed by the metalization of two faces of a dielectric solid having six faces and being differently presented. This is what FIG. 2 shows. This solid may be a parallelepiped. In this figure, a parallelepiped 4 can be seen made from a dielectric material and having a rectangular cross section with sides a and b. Metalizations 5 and 6 cover two opposite faces of the dielectric. Contrary to the microstrip line, the twin strip line has two similar electrodes. Side a is the distance which separates the two electrodes 5 and 6. Such a line propagates electromagnetic waves with an effective index $n_e=\lambda o/g$, $\lambda o$ represents the wave length in a vacuum and $\lambda g$ the wave length in the twin strip guide. This index depends on the dielectric constant of the material and the geometry of the line. Thus, using a dielectric bar made from barium tetratitanate $BaTi_4O_9$ with a dielectric constant of 37, and dimensions a and b between 5 and 10 mm, we obtain, for 1 GHz, $n_e=4.7$.

Such a line may present natural resonance frequencies depending on whether the value of its length L is an even or uneven multiple of $\lambda g/4$ and depending on the conditions at the limits. In practice, we will consider the two following cases:

half-wave resonator:

$$L=\lambda g/2$$

quarter-wave resonator:

$$L=\lambda g/4$$

Figure 3:
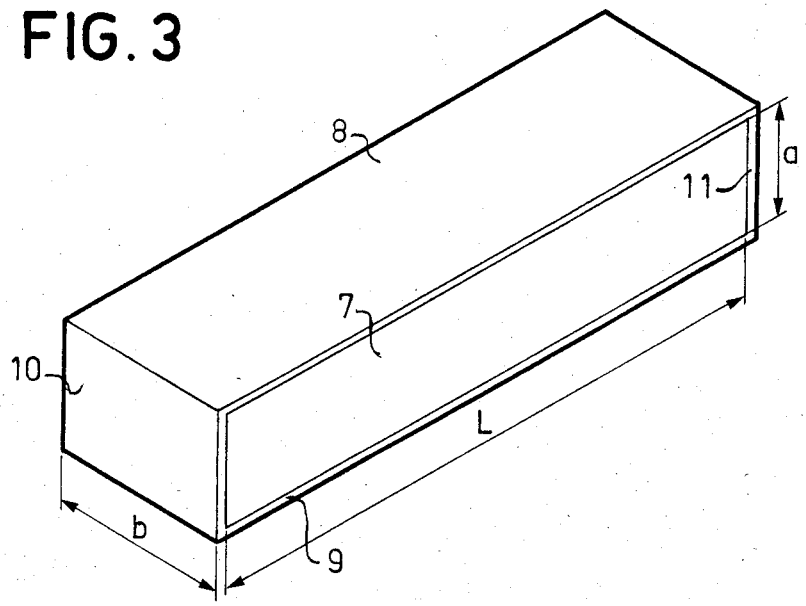

Half-wave resonators may be constructed as shown in FIG. 2, i.e. in open circuit, with $L=\lambda g/2$. They may also be of the type shown in FIG. 3. In this figure a twin strip wave-guide may be seen formed by a dielectric bar 7 covered on two of its faces with metal deposits 8 and 9. The conditions at the limits: metalizations of the ends 10 and 11 form thereof a $\lambda g/2$ resonator for $L=\lambda g/2$.

Figure 4:
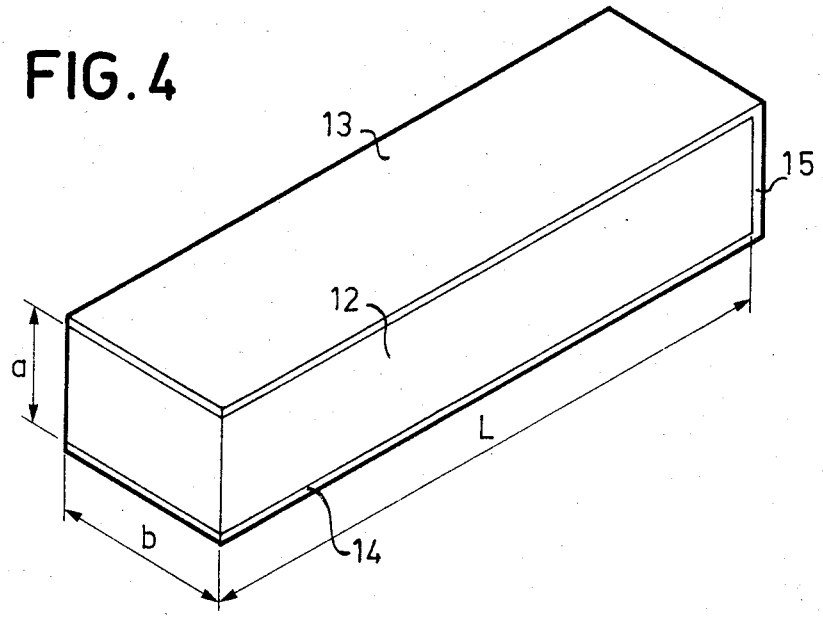
FIG. 4 shows a quarter-wave resonator in accordance with the invention.

A $\lambda g/4$ resonator is shown in FIG. 4. It is formed by a twin strip line defined by a dielectric bar 12, metalizations 13 and 14 and a short-circuit 15 caused by the metalization of one of the ends of the bar. Its length L is equal to $\lambda g/4$.

Using a material with a dielectric constant of 37 and metalizations formed from silver by silk-screen printing, the results shown in Table 1 are obtained. The measurements were made on square section resonators (a=b) of $\lambda g/4$ and $\lambda g/2$ type. Table 1, shown at the end of the description, also gives the values of the resonance frequency fo, of the Q factor at resonance, of volume V for each resonator. In fact, what is especially important for the cross section of the bar is the distance a which separates the metalizations. It can be seen, from an examination of table 1, that the Q factor is proportional to the line of intersection a and that, with a constant section, the Q factors varies as the square root of the frequency. We may write $Q=Ka\sqrt{f}$, K being a coefficient of proportionality. If we consider the Q factor/volume ratio of the dielectric, it can be seen that with the twin strip structure resonators may be obtained having excellent performances with respect to the space they occupy. For a given Q factor and volume, the choice may be made between the two types of resonator. For example, resonators 4 and 5 are equivalent from this point of view.

So as to obtain temperature stable resonators, it is advantageous to choose an appropriate dielectric. A material may for example be chosen such as those forming the subject of the Applicant's French Pat. No. 80 04601 filed on Feb. 29, 1980. These materials have relative molar proportions $tTiO_2$, $xSnO_2$, $yZrO_2$, aNiO, $bLa_2O_3$ and c Fe, where the parameters t,x,y,a,b and c satisfy the following inequalities:

$$0.9 \leqq t \leqq 1.1$$

$$0.1 \leqq x \leqq 0.4$$

$$0.6 \leqq y \leqq 0.9$$

$$0.015 \leqq a \leqq 0.06$$

$$0.01 \leqq b \leqq 0.1$$

$$0.001 \leqq c \leqq 0.01$$

For x close to 0.35, the thermal variation coefficient is cancelled out. With the high dielectric constant (about 37) of such materials, the volume of the resonators may be reduced for a given wave-length.

These resonators are typically intended for forming bandpass and band cut-off filters in the UHF range. They may also serve for stabilizing oscillators. Embodiments of filters of approximately 1 GHz are given below. They may be readily transposed to other frequencies and may be constructed equally well from $\lambda g/2$ or $\lambda g/4$ resonators.

For constructing filters, the type of resonator, their length and cross section may be chosen depending on the required performances.

Figure 5:
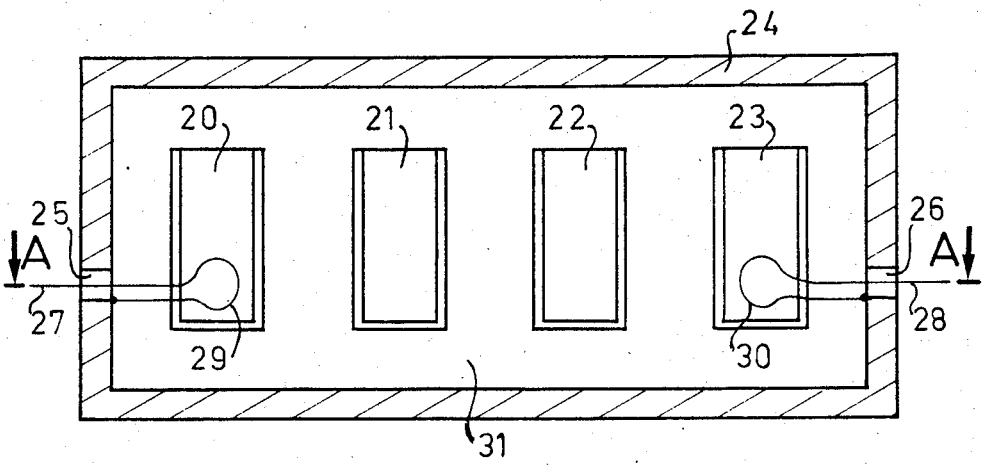
FIGS. 5 and 6 show a bandpass filter in accordance with the invention.

FIG. 5 shows one construction of a bandpass filter with four resonators 20, 21, 22 and 23. These correspond for example to number 3 in table 1, i.e. a=b=7 mm and of $\lambda g/4$ type. They are disposed in a grounded case 24. FIG. 5 is a top view of the case whose cover has been removed. A cross section has been taken at the level of the input and output holes 25 and 26 for the signal. Hole 25 allows therethrough a conductor 27 which forms a coupling loop 29, serving as energizing means, with the resonator 20. The end of conductor 27 is then connected to the case. The device for outputting the signal is formed similarly by a conductor 28 which forms a loop 30, which serves as collector means, at the level of resonator 23 and whose end is connected to ground. The bottom of the case is covered with an insulating substrate 31 which has for example a very low dielectric constant. The resonators are fixed to the substrate 31, for example by bonding. The metalizations of the quarter-wave resonators are respectively parallel to each other and perpendicular to the substrate as shown in FIG. 5. The coupling between resonators is provided by mutual inductance. The natural frequencies of each resonator have been previously adjusted either by manufacture, or by lapping. Tuning of the filter is then greatly facilitated. The resonators may also be separated by spacers made from a dielectric material with low dielectric constant. The distances between each resonator may be of the order of the intersection line a.

Figure 6:
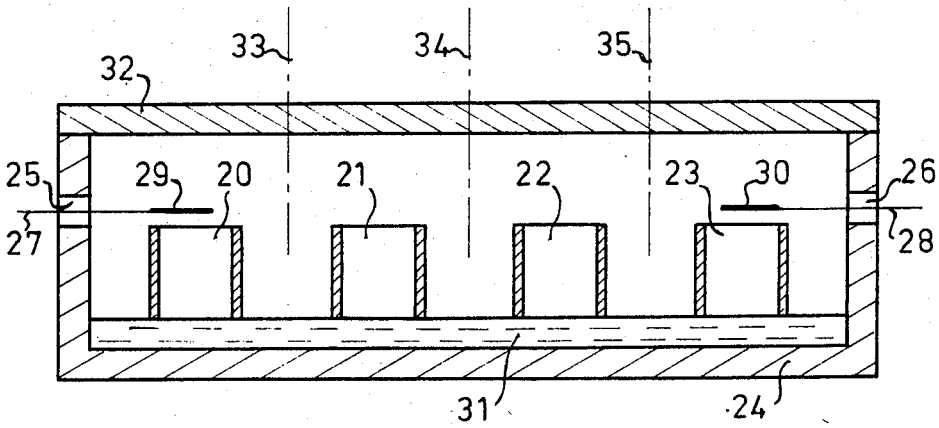

FIG. 6 is a sectional view of the filter shown in FIG. 5, the section being taken along A—A. In these two figures, the same references represent the same objects. A metal cover 32 closes the case and contributes to protecting the filter from external influences. It may be fixed to the case by screws, not shown. For fine adjustments of the couplings between resonators, it is possible to place adjusting screws along the axes 33,34 and 35. These screws, situated between the resonators, modify, depending on how far they are screwed in, the electromagnetic field which reigns between the resonators.

Figure 7:
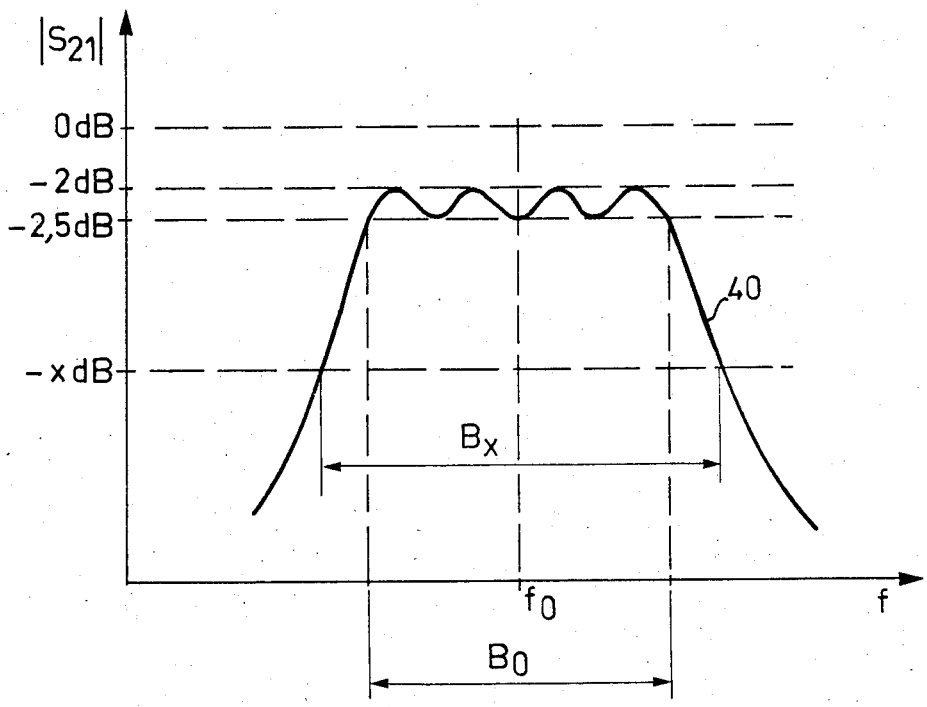
FIG. 7 is a diagram giving the response of a bandpass filter.

By way of example, the curve of the coefficient $|S_{21}|$ has been plotted as a function of the frequency f, i.e. the trend of the frequency response of the previously described four poles bandpass filter. This is what is shown in FIG. 7. The frequency response of the filter is shown by curve 40. The ordinate axis is graduated in decibels. The curve shows a maximum and two fairly steep edges which define a bandpass filter. The filter is characterized by a central frequency $f_o$, a passband $B_x$ at xdB, the undulation presented by the maximum which determines a passband $B_o$, insertion losses. The natural frequencies of resonators 20,21,22 and 23 are respectively 1060, 1080, 1080 and 1060 MHz. From the diagram of FIG. 7, it can be seen that:

the insertion losses in range $B_o$ are less than or equal to 2.5 dB;

a central frequency $f_o=1070$ MHz;

undulation in the band $B_o \leqq 0.5$ dB;

the passband $B_o=24$ MHz;

the passbands at 20 dB and 40 dB, $B_{20}=50$ MHz and $B_{40}=90$ MHz.

The measurements made on this filter also give $|S_{11}|$ in $B_o<0.1$.

By way of comparison, other measurements were made on a bandpass filter comprising three resonators having configurations identical to the preceding ones (a=b=6 mm, h=15 mm, $\epsilon_r=37$) and having natural frequencies of 1060 MHz for the input resonator, 1080

MHz for the middle one and 1060 MHz for the output one. The characteristics of this three poles filter are then: $f_o=1070$ MHz, $B_o=20$ MHz, $B_{20}=50$ MHz, and $B_{40}=110$ MHz. The coefficient $|S_{11}|$ of the diffusion matrix is less than 0.1.

Figure 8:
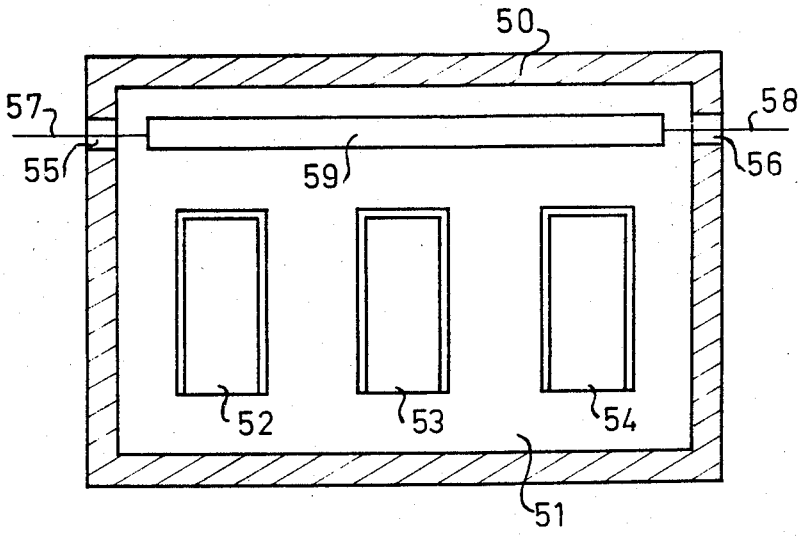
FIG. 8 shows a band cut-off filter in accordance with the invention.

The resonators of the invention lend themselves also very well to the construction of band cut-off filters. FIG. 8 shows such a filter. The cross section of the case has been made as for FIG. 5. There can be seen the case 5 on which is fixed a cover, not shown. The bottom of the case is covered with a substrate 51 made from a dielectric material with a low dielectric constant. The filter comprises three quarter-wave resonators 52, 53 and 54, holes 55 and 56 for passing therethrough a signal input conductor 57 and an output conductor 58 and a line 59 which may be the core of a coaxial line. The case and its cover are connected to ground. The distances separating the resonators from each other and from line 59 are of the order of size of the intersection line a. It is also possible to obtain with this kind of filter an adjustment of the couplings by the presence of screws modifying the electromagnetic field between the resonators.

The band cut-off and band pass filters formed from quarter-wave resonators present a first parasite response at a frequency substantially triple their operating frequency.

| No | Section (a = b) (mm) | Length L (mm) | Type | Frequency $f_o$ (MHz) | Q factor | Volume V ($cm^3$) |
|---|---|---|---|---|---|---|
| 1 | 5 | 15 | λg/4 | 1060 | 350 | 0.38 |
| 2 | 5 | 30 | λg/2 | 1130 | 500 | 0.75 |
| 3 | 7 | 15 | λg/4 | 1060 | 500 | 0.75 |

-continued

| No | Section (a = b) (mm) | Length L (mm) | Type | Frequency $f_o$ (MHz) | Q factor | Volume V ($cm^3$) |
|---|---|---|---|---|---|---|
| 4 | 7 | 30 | λg/2 | 1140 | 700 | 1.5 |
| 5 | 10 | 15 | λg/4 | 1060 | 700 | 1.5 |
| 6 | 10 | 30 | λg/2 | 1150 | 1000 | 3 |
| 7 | 15 | 15 | λg/4 | 1060 | 1000 | 3.2 |

What is claimed is:

1. A high frequency filter comprising:

a grounded case having a substantially rectangular shape having top and bottom surfaces wherein the bottom of said case is covered with an insulating substrate which has a low dielectric constant:

at least one resonator fixed to said substrate and wherein each said resonator comprises a dielectric body parallelepiped in shape having six faces with four of the said faces being entirely covered by metallic deposits and having two remaining opposite faces uncovered and wherein opposing metallic deposits are parallel to each other and perpendicular to the said substrate and wherein coupling to each resonator is provided by mutual inductance.

2. The high frequency filter as claimed in claim 1, wherein said resonators are arranged between energizing and collecting means forming the input and output terminals of said filter so that any incident electromagnetic energy is filtered successively by said resonators; the presence of said resonators producing a bandpass filter.

3. The high frequency filter as claimed in claim 1, wherein said resonators are arranged so as to take electromagnetic energy conveyed by a propagation line connecting together the input and output terminals of said filter; the presence of said resonators producing a band cut-off filter.

* * * * *